United States Patent [19]

Matsushita et al.

[11] 4,086,763

[45] May 2, 1978

[54] THERMAL REACTOR SYSTEM FOR INTERNAL COMBUSTION ENGINE

[75] Inventors: Toshiaki Matsushita, Hino; Yukio Shibata, Mitaka, both of Japan

[73] Assignee: Fuji Jukogyo Kabushiki Kaisha, Tokyo, Japan

[21] Appl. No.: 716,938

[22] Filed: Aug. 23, 1976

[30] Foreign Application Priority Data

| | | |
|---|---|---|
| Apr. 13, 1976 | Japan | 51-41595 |
| Apr. 13, 1976 | Japan | 51-41596 |
| Apr. 13, 1976 | Japan | 51-41597 |

[51] Int. Cl.[2] ..... F01N 3/10

[52] U.S. Cl. ..... 60/282; 60/323; 123/193 H

[58] Field of Search ..... 60/282, 323; 123/193 H, 123/191 A

[56] References Cited

U.S. PATENT DOCUMENTS

| | | | |
|---|---|---|---|
| 3,247,666 | 4/1966 | Behrens | 60/282 |
| 3,990,234 | 11/1976 | Kajitani | 60/282 |
| 4,037,408 | 7/1977 | Ozawa | 60/323 |

*Primary Examiner*—Douglas Hart

*Attorney, Agent, or Firm*—Martin A. Farber

[57] ABSTRACT

A thermal reactor system for internal combustion engines having a reaction chamber provided in the cylinder head. The reaction chamber is provided immediately behind the exhaust valve and has a predetermined capacity for inducing the oxidation of harmful constituents of the exhaust gases.

5 Claims, 9 Drawing Figures

THERMAL REACTOR SYSTEM FOR INTERNAL COMBUSTION ENGINE

The present invention relates to a thermal reactor for reducing the harmful constituents of the exhaust emission from the engine.

There has been provided a system for reducing the amount of unburned constituents such as carbon monoxide and hydrocarbons in which the constituents are oxidized in the exhaust system. In this system it is preferable to maintain the exhaust gases at a high temperature for a certain period to promote the oxidation of the unburned constituents. On the other hand, the maximum combustion temperature in the combustion chamber should be lowered in order to reduce nitrogen oxides. To meet these requirements, a system in which the spark timing is retarded has been provided. In accordance with the retarded spark timing, the maximum combustion temperature is low and temperature of the exhaust gases at the exhaust port may be elevated. However, because the retarded spark timing causes undesirable results such as an increase in fuel consumption, the retarded spark timing must be determined in a necessary minimum angle.

Accordingly, it is an object of the present invention to provide a thermal reactor system which has a high reduction rate of harmful constituents whereby the retardation of the spark timing may be set in the minimum angle enough to decrease nitrogen oxides without further retardation for raising the exhaust gas temperature for promotion of the oxidation of carbon monoxide and hydrocarbons.

It is another object of the present invention to provide a thermal reactor system which is simple in construction.

It is still another object of the present invention to provide a thermal reactor system which may reduce the harmful constituents to the required amount without providing an exhaust gas purification system in the exhaust system.

The present invention is characterized in that a reaction chamber is provided in the cylinder head behind the exhaust valve and oxidation of exhaust gases occurs in the reaction chamber at a high temperature.

In the conventional exhaust thermal reactor system, the thermal reactor is positioned in the exhaust passage after the outlet of cylinder head. In order to maintain the exhaust gases at a high temperature in such a system, the exahust passage and thermal reactor are coated with insulation material. According to inventor's experiments, it has been found that sufficient oxidation cannot be expected in the termal reactor provided in the exhaust passage, because of the exhaust gas temperature drop in the exhaust passage. In order to elevate the exhaust gas temperature, the spark timing is retarded and in order to maintain the temperature at a high level sufficient to induce the oxidation, a large scale insulation must be provided on a great part of the exhaust system which will increase the cost of the system.

In accordance with the present invention, the exhaust gas temperature drop may be prevented, because the reaction chamber is provided closely adjacent to the exhaust valve. Further it is possible to greatly reduce the harmful constituents of the exhaust gases even if the exhaust gas temperature at the exhaust port is lower than that of the conventional engine. This means that a large retarded spark timing for obtaining the high exhaust gas temperature is not necessary. Accordingly, it is possible to provide an internal combustion engine which has high power and low fuel consumption because the retardation angle of the spark timing may be set in a minimum angle sufficient to reduce the amount of nitrogen oxides to a standard level.

Other objects and aspects of the present invention will become apparent from the following description of preferred embodiments with reference to the accompanying drawings in which.

Figure 1:
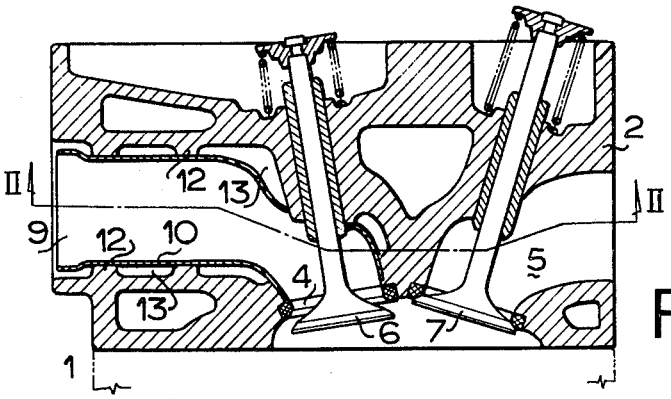
FIG. 1 is a cross-sectional view of an embodiment of the present invention.
Figure 2:
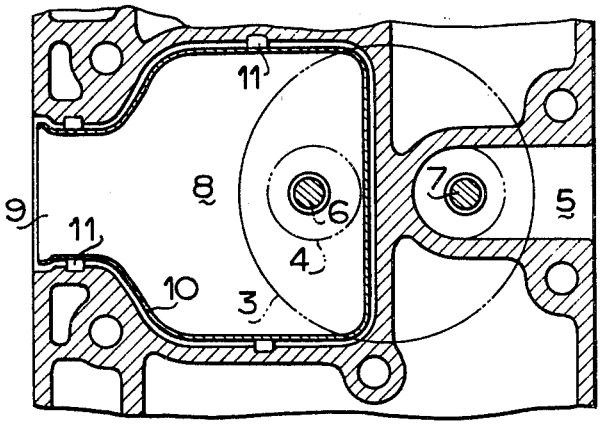
FIG. 2 is a sectional view taken along line II—II of FIG. 1.

Referring to FIGS. 1 and 2, the figures show a part of the cylinder head for multi-cylinders. As shown in FIG. 1, the cylinder head 2 is secured to a cylinder block 1 with bolts and a cylinder 3 is formed in the cylinder block 1. The cylinder head 2 is provided with exhaust and intake ports 4 and 5 which have exhaust and intake valves 6 and 7 respectively. A reaction chamber 8 having a predetermined capacity for inducing the oxidation of the harmful constituents is provided in the cylinder head immediately behind the exhaust port 4. The reaction chamber 8 is communicated to an exhaust passage 9 which is in turn communicated to an external exhaust passage (not shown). The inner wall of the reaction chamber 8 and exhaust passage 9 is lined with a lining 10 for heat insulation. The lining is previously made of heat resisting steel and formed into a shape of the reaction chamber. The lining 10 is inserted in the cylinder head 2 at the casting thereof. On the outer side of the lining projections 11 are provided which are inserted into the cast metal to hold the lining. There are also provided projections 12 in the cavity of the cylinder head, supporting the lining 10 and forming an insulation space 13 between the lining and the cylinder head.

The reaction chamber 8 has a predetermined capacity sufficient enough to obtain a long residence time of the exhaust gases and to effect sufficient mixing of the gases, so that carbon monoxide and hydrocarbons are sufficiently oxidized. The predetermined capacity of the reaction chamber is selected between $\frac{1}{4}$ and 2 times the piston stroke volume of the corresponding cylinder, preferably at $\frac{3}{4}$ thereof.

Figure 3:
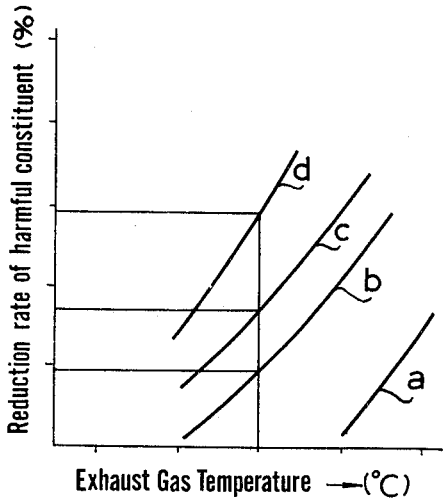
FIG. 3 shows the relation between the exhaust gas temperature and the reduction rate of harmful constituents in which residence time is taken as a parameter.

According to the experiments, it has been found that the length of the residence time of the exhaust gases in the reaction chamber has a great influence on the oxidation of the harmful constituents in exhaust gases, and that the harmful constituents in the exhaust gases are reduced remarkably by increasing the residence time. FIG. 3 shows how the relation between the reduction rate of carbon monoxide and hydrocarbons and the exhaust gas temperature varies according to residence time in the reaction chamber. Curve *a* is the relation between the reduction rate of harmful constituents and the exhaust gas temperature in the conventional thermal reactor system in which oxidation takes place in the exhaust passage after outlet from the cylinder head for a short residence time and curves *b, c,* and *d* are relations in the reaction chamber of the present invention having long residence times. The graph shows that the reduction rate of the present invention is almost twice the reduction rate of the conventional system under the same temperature conditions of the exhaust gas. In other words, the present invention enables reduction of the amount of the exhausted harmful constituents, even if the exhaust gas temperature is lower than that of the conventional engine. Therefore, it is not necessary to retard the spark timing in order to raise the exhaust gas temperature, whereby it is possible to put the power of the engine to the utmost and good fuel consumption can be expected.

Figure 4:
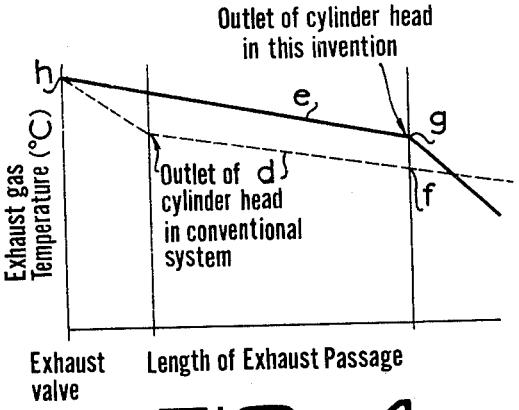
FIG. 4 shows variation of exhaust gas temperature in the present invention and in the conventional engine in which the horizontal axis is the length of the exhaust passage when the volume of the exhaust passage including the reactor is converted into the length of exhaust pipe having a constant sectional area.

FIG. 4 illustrates a comparison of the temperature the exhaust gases out of the exhaust valve in the conventional thermal reactor system and in the present invention, in which the horizontal axis is equivalent pipe length to the volume of the exhaust passage. In the figure, temperature in the passage of the conventional thermal reactor system is indicated by *d* and that of the present invention by *e*. In the conventional system, between the exhaust valve and the outlet from the cylinder head, the exhaust gas temperature drops rapidly and in the exhaust passage, the drop of temperature becomes slow. On the other hand, in the present invention, because the exhaust gases are oxidized in the reaction chamber immediately after the exhaust valve, the drop rate of the exhaust gas temperature is low and the temperature at the outlet point *g* is much higher than the temperature at the point *f* of the conventional system. Accordingly, it should understood that oxidation may be actively take place in the reaction chamber of the present invention. It will be understood that a sufficient effect can be expected in the present invention if the temperature at the point *h*, where the exhaust gases exit from the exhaust valve, is lowered. In the conventional thermal reactor system in order to raise the temperature at the point *h*, which means that active reaction in the exhaust system may be expected, the spark timing is retarded. The retardation of the spark timing also provides a decrease in the maximum combustion temperature which results in the reduction of nitrogen oxides.

Figure 5:
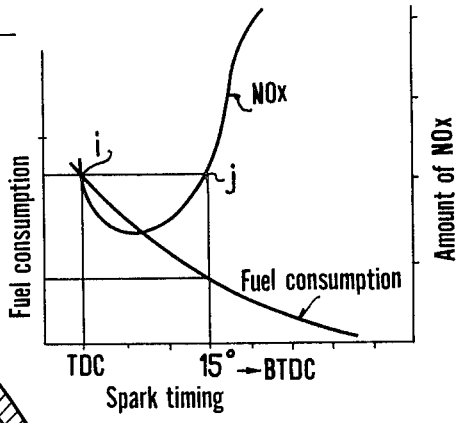
FIG. 5 shows the relation between the spark timing and fuel consumption and the relation between the spark timing and amount of nitrogen oxides.

FIG. 5 shows the relations between the spark timing, fuel consumption in operation by the ignition of MBT (maximum advance for best torque) and amount of nitrogen oxides. As the spark timing is advanced, the fuel consumption decreases, but the nitrogen oxides are increased. The amount of nitrogen oxides is least at BTDC 5°, or thereabout. According to the present invention, as mentioned above, it is unnecessary to make the exhaust gas temperature higher by retarding the spark timing because sufficient oxidation may be expected at a lower exhaust gas temperature at the exhaust valve.

In the conventional thermal reactor system, the spark timing is set about the top dead center to obtain the point *i*. To the contrary the timing in the present invention may be advanced about BTDC 15° to obtain the same point *j* as the convention thermal reactor system and to decrease the specific fuel consumption.

Figure 6:
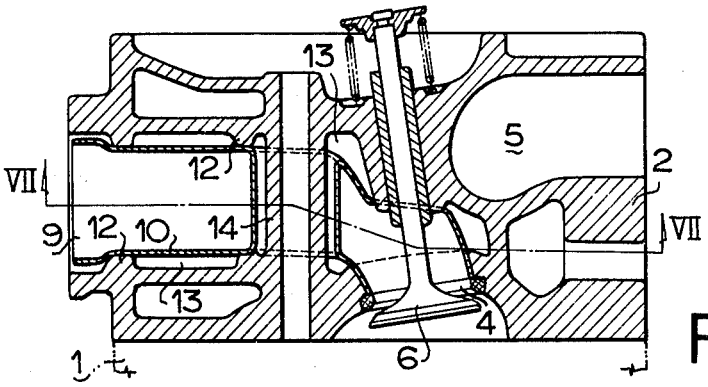
FIG. 6 is a sectional view of another embodiment of the present invention.
Figure 7:
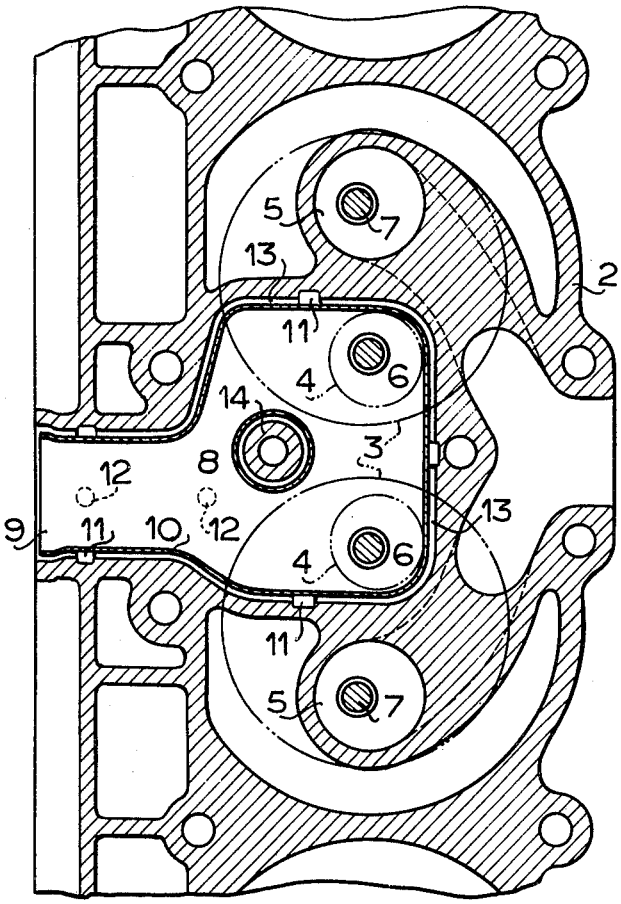
FIG. 7 is a sectional view taken along line VII—VII in FIG. 6.

In the embodiment shown in FIGS. 6 and 7, the reaction chamber 8 is provided over two cylinders 3 and 3 to include both exhaust valves 6 and 6 which communicate therewith. In this system a boss 14 is provided through the reaction chamber at a central portion thereof and a bolt for securing the cylinder head 2 to the cylinder block 1 is inserted into the boss 14.

In accordance with this embodiment, since the reaction chamber 8 is provided over two cylinders, exhaust gases from each cylinder flow into the chamber at intervals of short time periods thereby the reaction chamber is always held at a high temperature and further, subsequent exhaust gases would be mixed with previous exhaust gases. Further, the boss 14 in the reaction chamber causes the mixing and turbulence of the exhaust gases, which enhances the oxidation of the gases. Thus, a greater reduction of harmful constituents than with the afore-mentioned embodiment may be expected.

Figure 8:
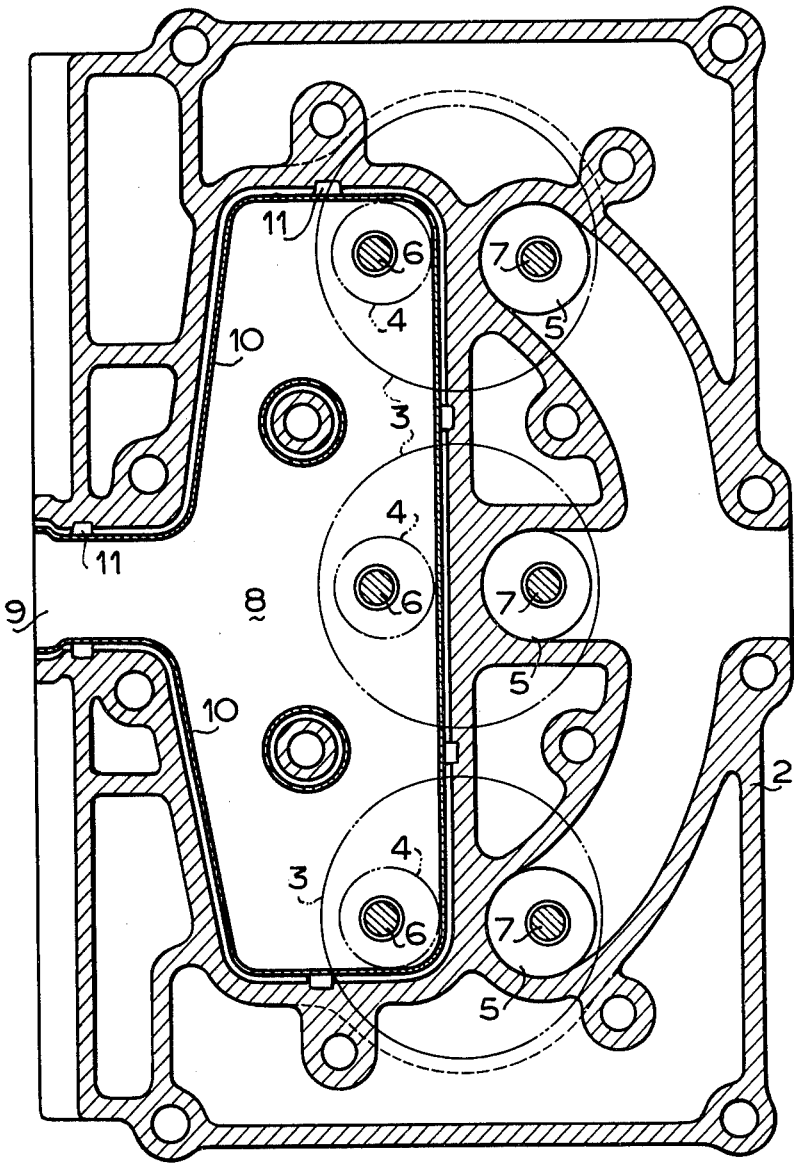

In the embodiment of FIG. 8, the reaction chamber 8 is provided over and communicates with three cylinders. In accordance with this embodiment, the residence time and mixing effect may be further increased, since the capacity of the reaction chamber is enlarged and the exhaust gases may be continuously introduced in into the chamber. It should be noted that the capacity of the reaction chamber in these embodiments in which the reaction chamber is provided to include two or more exhaust pipes is selected between ¼ and 2 times the total piston stroke volume of all of the corresponding cylinders.

Figure 9:
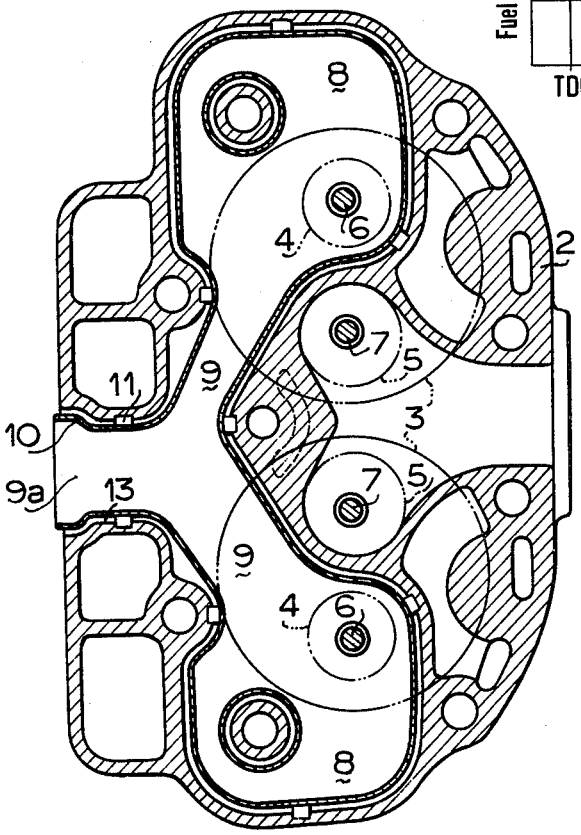
FIG. 8 and 9 are sectional views of further embodiments respectively.

In the embodiment of FIG. 9, a couple of reaction chambers are connected to a common exhaust passage 9*a*. In accordance with this embodiment, an exhaust manifold 15 to be provided outside of the cylinder head can be simplified.

What is claimed is:

1. A thermal reactor system for internal combustion engines comprising
   - a cylinder block formed with a cylinder defining a combustion chamber,
   - a piston reciprocally disposed in said cylinder defining a piston stroke volume,
   - a cylinder head provided on said cylinder block and having an outlet, and an exhaust port communicating with said combustion chamber of said cylinder,
   - a reaction chamber formed in said cylinder head positioned immediately behind said exhaust port in communication therewith,
   - said reaction chamber having a capacity between ¼ and 2 times the piston stroke volume of said cylinder for inducing oxidation of harmful constituents of the exhaust gases, and
   - an exhaust passage communicating said reaction chamber with said outlet of said cylinder head.

2. The thermal reactor system for internal combustion engines in accordance with claim 1, further comprising
   - heat insulation means for insulating said reaction chamber and said exhaust passage.

3. A thermal reactor system for internal combustion engines comprising
   - a cylinder block formed with at least one cylinder defining at least one combustion chamber,
   - a piston reciprocally disposed in each of said at least one cylinder, respectively, defining a piston stroke volume in each of said at least one cylinder, a cylinder head provided on said cylinder block and having an outlet, and an exhaust port communicating with each of said at least one combustion chamber of said at least one cylinder, respectively, a reaction chamber formed in said cylinder head positioned immediately behind said exhaust port in communication therewith, said reaction chamber having a capacity between ¼ and 2 times the piston stroke volume of a corresponding of said at least one cylinder for inducing the oxidation of harmful constituents of the exhaust gases, and an exhaust passage communicating said reaction chamber with said outlet of said cylinder head.

4. A thermal reactor system for internal combustion engines comprising a cylinder block formed with at least two cylinders defining at least two combustion chambers, respectively, a piston reciprocally disposed in each of said cylinders, respectively, defining a piston stroke volume in each of said cylinders, a cylinder head provided on said cylinder block and having an outlet, and an exhaust port communicating with each of said at least two combustion chambers of each of said at least two cylinders, respectively, a common reaction chamber formed in said cylinder head positioned immediately behind said exhaust ports in communication therewith, said reaction chamber having a capacity between ¼ and 2 times the total piston stroke volume of said at least two cylinders for inducing the oxidation of harmful constituents of the exhaust gases, and an exhaust passage communicating said reaction chamber with said outlet of said cylinder head.

5. A thermal reactor system for internal combustion engines comprising a cylinder block formed with at least two cylinders defining at least two combustion chambers, respectively, a piston reciprocally disposed in each of said cylinders defining a piston stroke volume, respectively, a cylinder head provided on said cylinder block and having an outlet, and an exhaust port communicating with each of said combustion chambers of said cylinders, respectively, at least two reaction chambers formed in said cylinder head positioned respectively immediately behind a corresponding of said exhaust port in communication therewith, each of said reaction chambers having a capacity between ¼ and 2 times the piston stroke volume of said cylinders respectively communicating therewith for inducing the oxidation of harmful constituents of the exhaust gases, exhaust passages communicating respectively with each of said reaction chambers, and a common exhaust passage communicating an end of each of said exhaust passages to said outlet of said cylinder head.

* * * * *

UNITED STATES PATENT AND TRADEMARK OFFICE

CERTIFICATE OF CORRECTION

PATENT NO. : 4,086,763

DATED : May 2, 1978

INVENTOR(S) : Toshiaki Matsushita et al

It is certified that error appears in the above-identified patent and that said Letters Patent are hereby corrected as shown below:

COLUMN 1, line 53, "termal" should be --thermal--

COLUMN 3, line 24, after "temperature" should read --of--

COLUMN 3, line 41, after "should" insert --be--.

COLUMN 3, line 42, "be" should be cancelled

COLUMN 4, line 27, "in" should be cancelled

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*